US005799978A

United States Patent [19]

Grinnell

[11] Patent Number: 5,799,978

[45] Date of Patent: Sep. 1, 1998

[54] COATED BOOK COVER

[75] Inventor: Gary Churchill Grinnell, Northampton, Mass.

[73] Assignee: Rexam DSI Incorporated, South Hadley, Mass.

[21] Appl. No.: 599,781

[22] Filed: Feb. 12, 1996

[51] Int. Cl.[6] ..... B42D 3/00

[52] U.S. Cl. ..... 281/29; 281/19.1; 281/35; 281/37; 428/514; 428/511; 428/328; 428/331; 524/492; 524/445; 524/497; 524/493

[58] Field of Search ..... 524/492, 493, 524/494, 445, 447, 448, 449, 450, 451, 452, 497; 428/511, 514, 328, 331; 412/4, 8; 281/19.1, 29, 35

[56] References Cited

U.S. PATENT DOCUMENTS

| | | | |
|---|---|---|---|
| 2,899,299 | 6/1959 | Ritson | 260/29.6 |
| 2,919,206 | 12/1959 | Malmquist | 117/76 |
| 3,041,222 | 6/1962 | Malmquist | 154/52 |
| 3,249,463 | 5/1966 | Carlee | 117/76 |
| 3,345,196 | 10/1967 | Goldbeck | 117/11 |
| 3,365,410 | 1/1968 | Wesslau et al. | 260/29.6 |
| 4,652,471 | 3/1987 | van Rooden et al. | 427/411 |
| 5,169,715 | 12/1992 | Maubert et al. | 428/311 |
| 5,171,627 | 12/1992 | Brockington et al. | 428/220 |
| 5,480,702 | 1/1996 | Matsumoto | 428/209 |

OTHER PUBLICATIONS

Hycar® 26138 Technical Data.
Hycar® 26796 Technical Data.
Hycar® 2679 Technical Data.
Hy Stretch™ Latex V-29 Technical Data.
Rhoplex® B-959 Technical Data.
Rhoplex® E-32 Technical Data.
Rhoplex® E-358 Technical Data.

*Primary Examiner*—Vasu Jagannathan
*Assistant Examiner*—U. K. Rajguru
*Attorney, Agent, or Firm*—Ratner & Prestia

[57] ABSTRACT

An improved cover material for hard- and soft-book covers is disclosed. The material comprises a conventional substrate, such as paper, and a coating that comprises an acrylic binder, the binder having a Tg of −10° to 10° C., and a filler system, the filler system comprising (a) about 2.0% to about 7.0% of silica or a silicate; (b) about 28% to about 38% of calcined clay; (c) about 20% to about 27% of titanium dioxide; and (d) about 30% to about 45% of a white filler pigment. The filler system may additionally comprise 3% to 7% of a pigmentary polymeric particulate. The laminate may also additionally comprise a protective top coat coated over the layer of cover material.

11 Claims, 1 Drawing Sheet

COATED BOOK COVER

FIELD OF THE INVENTION

This invention relates to covers for hard- and soft-cover books. More particularly, this invention relates to a laminate suitable for use as a book cover.

BACKGROUND OF THE INVENTION

"Book cover material" refers to the outer covering material which is applied to binder boards to form the covers of "hardback" or "hard-cover" books. Alternatively, the "book cover material" may form the complete cover of the book, i.e., a self-supporting cover, such as in "paperback", "soft-cover" or "self-supporting cover" books.

Book binding requires a material that is flexible, that possesses archival properties, and that can feed properly on high speed printing equipment, such as case makers, building-in machines, foil stamping, and similar operations. Ideally the material should be: printable with established book cover inks; adaptable to normal printing and embossing processes, such as lithographic printing and hot stamp lettering processes; receptive to conventional bindery adhesives and over print lacquers; adaptable to automatic bindery processes; resistant to wear such as scuffing, abrasion, creasing, dirt pickup, and cracking, especially at the fold or hinge lines; cleanable with mild cleaners such as warm water and detergent; and harmless to surfaces with which books are likely to be in contact for extended periods, such as other book covers and furniture finishes.

The covers of hard-cover books are typically either leather, cloth, paper, or vinyl because these substrates can be readily formed, printed and/or stamped to provide a quality cover for the book. In mass-produced hard cover books generally only cloth, paper, and vinyl are used as book covers. These substrates are generally coated with other materials to enhance the requisite properties. Book cover materials are disclosed in Malmquist, U.S. Pat. Nos. 2,919,206 and 3,041,222; Carlee, U.S. Pat. No. 3,249,463; and Goldbeck, U.S. Pat. No. 3,345,196.

Coated paper remains the most economical material for the manufacture of both hard- and soft-cover books. However, conventional offset coatings do not have the durability and flexibility required for high durability book binding applications. This lack of durability is noted in hinge and spine areas of a book covering which are stressed and strained during the opening and closing of the book. On the other hand, coatings that are durable and flexible typically do not have good offset printing capability. Therefore, it had not been possible to simultaneously achieve both optimal printing capability and the durability and flexibility required for premium book covers. Thus, a need exists for a coating material, suitable for use in the manufacture of book covers, that is durable and flexible yet has good offset printing capability.

SUMMARY OF THE INVENTION

In one embodiment, the invention is a laminate suitable for use as a book cover material, said laminate comprising:

(A) a substrate, and (B) a layer of cover material adhered to said substrate, said cover material comprising:

(1) an acrylic binder, said binder having a Tg of −10° to 10° C.; and (2) a filler system, said filler system comprising (a) about 2.0% to about 7.0% of silica or a silicate;

(b) about 28% to about 38% of calcined clay;

(c) about 20% to about 27% of titanium dioxide; and (d) about 30% to about 45% of a white filler pigment;

wherein the percentages are percents by weight based on the dry weight of the filler system, and wherein the ratio of filler system to binder is about 2.1 to 3.1. preferably the ratio of filler system to binder is about 2.4 to 2.8 and the Tg of the acrylic polymer is about −5° C. to 5° C. The filler system may additionally comprise 3% to 7% of a pigmentary polymeric particulate. The laminate may also additionally comprise a protective top coat coated on the layer of cover material.

In another embodiment, the invention is a book comprising a cover, wherein the cover comprises a laminate comprising:

(a) a substrate, and (b) a layer of cover material adhered to said substrate, said cover material comprising:

(1) an acrylic binder, said binder having a Tg of −10° C. to 10° C.; and (2) a filler system, said filler system comprising (a) about 2.0% to about 7.0% of silica or a silicate;

(b) about 28% to about 38% of calcined clay;

(c) about 20% to about 27% of titanium dioxide; and (d) about 30% to about 45% of a white filler pigment;

wherein the percentages are percents by weight based on the dry weight of the filler system, and wherein the ratio of filler system to binder is about 2.1 to 3.1.

DETAILED DESCRIPTION OF THE INVENTION

The invention is a laminate suitable for use as a book cover material. The laminate comprises a conventional book cover substrate and a novel coating that is printable, especially by offset printing, and both flexible and durable. The coating imparts the high durability needed for quality book manufacture and provides superior performance when used in commercial coated book covers. In addition, the coating enhances the durability of the book cover even after a protective coating has been applied over the coating and printing.

Figure 1:
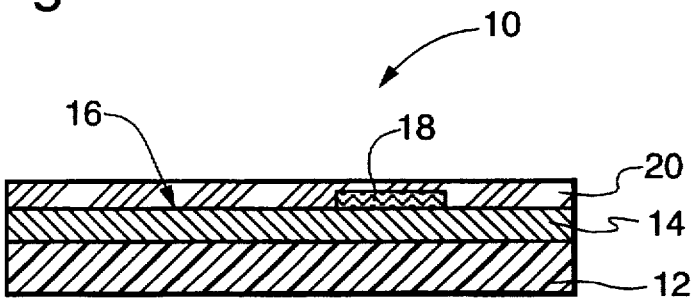
FIG. 1 depicts the cross-section of a laminate suitable for use as a book cover material.

Referring to FIG. 1, laminate 10, suitable for use as a book cover material, is comprised of substrate 12, coated with layer of cover material 14, which may have printing 18 on its upper surface 16. protective top coat 20 may be coated on upper surface 16 of layer 14, forming a protective coating over layer 14 and printing 18. Layer 14 comprises an acrylic polymer and a filler system.

Acrylic Polymer

The glass transition temperature (Tg) of the acrylic polymer is important to the performance of the cover material. When the Tg is too high, the ability of the layer to flex without cracking is lost. When the Tg is too low, the material is too soft causing tacky surfaces. Tacky surfaces can cause multiple feeds, which jam processing equipment. The acrylic polymer should have a Tg between −10° C. and 10° C., preferably, between −5° C. and 5° C. Certain polymers are characterized by a "$T_1$" or a "$T_{300}$", defined as the temperature at which the torsional modulus of an air-dried film is 300 kg/cm$^3$. For purposes of this invention, $T_1$ and $T_{300}$ are equivalent to Tg.

In addition, the acrylic polymer should have good coatability properties when formulated with the filler system to form the coating composition. If the binder has cross-linking ability when exposed to heat, solvent resistance, heat resistance, and toughness are imparted to the final product.

Although the invention is not limited to polymers of any particular composition, useful polymers will typically be polymers and copolymers of esters of acrylic and/or methacrylic acid with alcohols having 1 to 8 carbon atoms, more typically 1 to 4 carbon atoms, which may be co-polymerized with smaller amounts other monomers, such as vinyl acetate and acrylonitrile. A small amount of a monomer such as methylol acrylamide may be included so that polymer will cross-link when exposed to heat. Preparation of polymers of this type is well known to those skilled in the art. The acrylic polymer is conveniently handled as a polymer latex.

Surprisingly, certain acrylic polymers have been found that give good print performance, even though they are not specifically designed for use in printing. Hycar® 2679, a heat-reactive acrylic polymer suggested as a saturant and/or backcoating for textile fabrics, nonwoven fabrics, and paper, can be used. This material is believed to be composed of ethyl acrylate copolymerized with acrylonitrile and methylol acrylamide. HyStretch™ V-29, an elastomeric terpolymer used in industrial fabric finishes, which has a Tg of −29° C., provides a cover material that is too soft for efficient processing. Hycar® 26138, a heat-reactive acrylic copolymer latex, which has a Tg of 25° C., provides a cover material that is too hard and, thus, does not provide acceptable flexibility.

Filler System

The selection of the filler system, or pigmentation system, is particularly important for optimum performance. The filler system determines the whiteness of the coating, the ink adhesion, the absorption rate of the fountain solution, the absorption rate of the ink, the ink "snap" or the color development of the ink, and the coatability of the coating formulation.

The filler system generates void volume in the surface of the coating and provides the surface with the proper hydrophobic/hydrophilic balance. This allows the surface to accept ink while the fountain solution is pulled into the coating. If the fountain solution from the previous station remains on the coating surface, it will repel the applied ink at the next station, a phenomenon known as "wet repellance."

The filler system consists of a combination of pigments. Pigment means a finely divided particulate material, normally insoluble in the polymer phase. The filler system comprises: silica or a silicate, such as calcium silicate or sodium aluminum silicate; calcined clay; titanium dioxide; and an inexpensive white filler pigment, such as hydrated clay. In addition, a pigmentary polymeric particulate or "plastic pigment," such as particles of a cross-linked organic polymer, may be present. Preferably, the pigments are in the range of (% by weight based on the total dry weight of the filler system): silica or silicate, about 2.0% to about 7.0%; calcined clay, about 28% to about 38%; titanium dioxide, about 20% to about 27%; white filler pigment, about 30% to about 45%, and pigmentary polymeric particulate, if present, about 3% to 7%. More preferably, the pigments are in the range of: silica or silicate, about 3.0% to about 5.0%; calcined clay, about 30% to about 33%; titanium dioxide, about 21% to about 25%; white filler pigment, about 33% to about 38%, and pigmentary polymeric particulate, about 4% to 6%.

With the incorporation of low levels of the proper silica into the coating, the problem of wet repellance can be avoided in low filler/binder ratio coating systems. Surprisingly, in addition to promoting absorption of fountain solution, addition of small amounts of silica, which is normally used as a flattening agent to reduce gloss in coatings, also increases ink gloss.

The selection of silica or silicas from the many grades that are commercially available is particularly important. Not all grades of silica have mix viscosities that will produce a favorable coating rheology. If the silica causes too great an increase in the viscosity of the coating composition, the coating process can be adversely affected. Silicas also differ in water absorption, which affects fountain solution absorption. Some grades are prone to "dusting" during mix preparation. This causes cleanup problems as well as health hazards due to inhalation.

Silicas that are surface coated to give hydrophobic properties are not favorable for dispersion in water or for the absorption of fountain solution in the final coating. Because the drying of offset inks is generally inhibited by a pH below 7.0, acidic silicas are not preferred. In addition, for archival purposes on cellulosic substrates, silicas with a pH above 7.0 are preferred.

Calcined silicas are not preferred. In particular, calcined diatomaceous earths, calcined silicas derived from microscopic organisms, are very hard. Because of this hardness and particle morphology, these silicas cause unwanted abrasiveness.

Generally, an average particle size under 10 microns is preferred. Blends of various particle size silica can give beneficial performance. Various ratios of 1.0, 3.0, and 5.0 micron particles can be blended for particular performance and coating requirements. Examples of useful silicas include Syloid® W-500 silica, Syloid® W-300 silica, and combinations thereof.

Various silicates may be used in place of, or in combination with, silica. Calcium silicate, such as Hubersorb® 600, and sodium aluminum silicate, such as Huberfill®, Hydrex®, and the Zeolex® series can be used. Also useful are silica sols, a colloidal form of silica in water, such as Ludox® and Nalco sols.

Calcined clay is moderate cost space filler that generates more void volume than hydrated clay and other inexpensive while filler pigments. A useful calcined clay is Ansilex® 93 calcined clay.

The inexpensive white filler pigment aids both printability and opacity while minimizing cost. Typical inexpensive white filler pigments are hydrated clay, calcium carbonate, and barium sulfate. A useful hydrated clay is Hydro Gloss® 90 hydrated clay.

Figure 2:
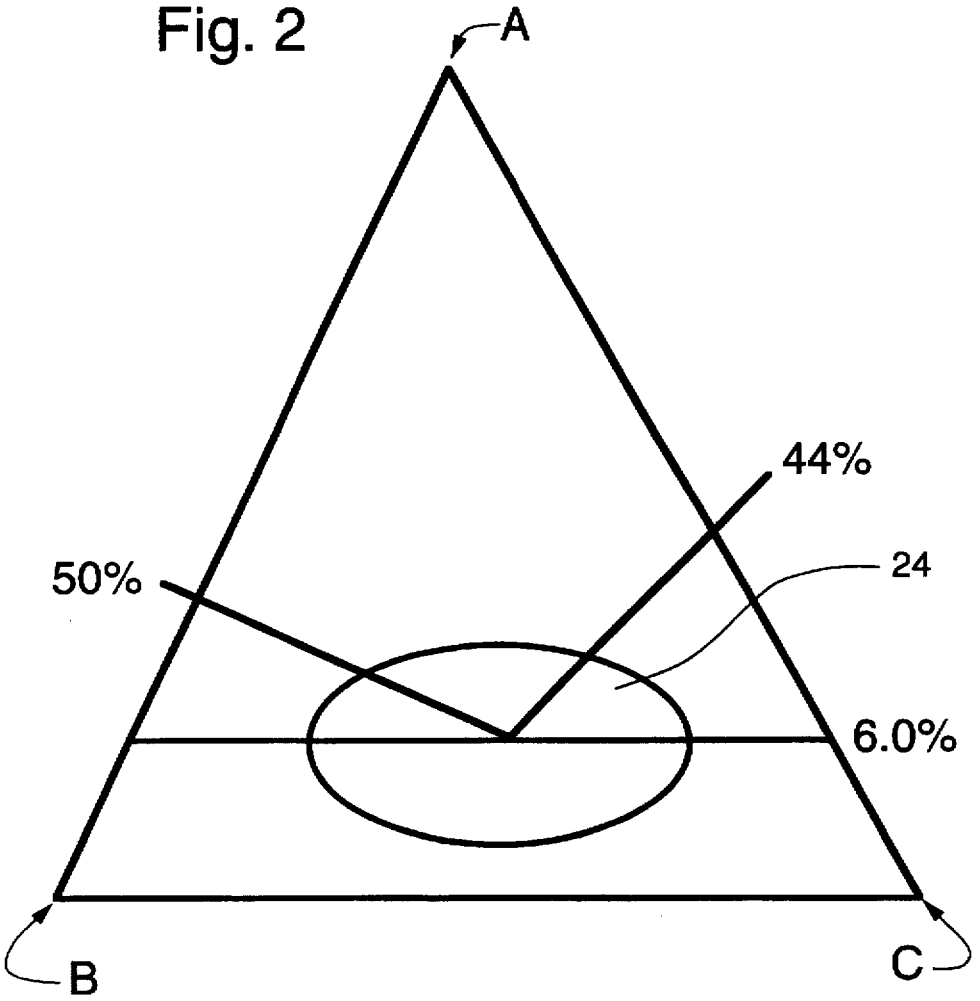
FIG. 2 represents the area of formulation latitude for three components of the filler system: silica, calcined clay, and white filler pigment.

Referring to FIG. 2, ellipse 24 shows the formulation latitude in the three component system consisting of white filler pigment, calcined clay, and silica or silicate, expressed in weight percent of each component in the three component system. Apex A represents 100% silica or silicate, apex B represents 100% white filler pigment, and apex C represents 100% calcined clay. A preferred composition, based on the weight of these components, is about 6.0% silica or silicate, about 44% calcined clay, and about 50% white filler pigment. These three components together typically comprise about 55% to 85% of the filler system. As will be apparent to those skilled in the art, for economic reasons the formulation will typically comprise the minimum amount of silica and the maximum amount of white filler pigment required to obtain acceptable performance for the intended application.

Titanium dioxide provides whiteness and opacity to the cover material. The filler system should comprise sufficient titanium dioxide to provide the desired level of whiteness and opacity. The filler system comprises about 20 to 27% titanium dioxide.

Pigmentary polymeric particles add opacity to the coating and enhance gloss, especially on calendering. Examples of pigmentary polymeric particles include fine particles of cross-linked polystyrene, cross-linked polyvinyl chloride, and cross-linked acrylic polymers and co-polymers, such as cross-linked polymethyl methacrylate. A useful material is Ropaque® HP-91, a styrenated acrylic.

Other Components

The cover material may comprise additional components that are conventionally used to disperse pigments, to facilitate coating, and the like. Such components include surface active agents, dispersing agents, and the like. Surface active agents, i.e., surfactants, soaps, etc., are used to disperse pigments within the coating composition as well as wetting agents during coating of the coating material on the substrate. Typical surface active agents include, for example, block copolymers of ethylene and propylene oxide; alcohol and alkyphenyl ethoxylates; alkylaryl polyether alcohols; and dioctyl sodium sulfosuccinates. Dispersing agents are used in minor concentrations to facilitate pigment compatibility with the coating and coated layer compositions. Typical dispersing agents include conventional anionic polyelectrolytes; polyphosphate compounds such as tetrasodium pyrophosphate, sodium hexametaphosphate, and sodium tripolyphosphate; and sodium salts of carboxylated polyelectrolytes. Typical polymeric dispersing agents include sodium polyacrlyates; block copolymers of ethylene and propylene oxide; polyvinyl alcohol; lactic acid sodium casein; and modified cellulosic compounds such as methyl cellulose, cellulose acetate, cellulose acetate butyrate, polyvinyl acetate, or other hydroxyethyl, carboxymethyl, or hydroxypropyl modified cellulosic compounds. Other conventional processing additives include air entrainment control agents, compounds for pH and microbe control, and the like.

Small amounts of conventional thickeners, such as methyl cellulose, hydroxypropyl methyl cellulose, and alginates and related thickening agents, can be added to the coating composition without adversely affecting the properties of the laminate.

Small amounts of colored dyes or colored pigments may be added to the coating material to achieve a desired color. Typical colored pigments are inorganic or organic powders, typically having an average maximum particle size of about 1 micron or less, such as carbon black, iron oxides, phthalocyanines, chromium compounds, azo compounds, and dioxanine and anthraquinone compounds.

Substrate

The cover material may be applied to any substrate that meets the manufacturing criteria for book covers. Substrate 12 should possess the conventional surface and physical properties for its intended use such as tensile and tear strength, stiffness, fold endurance, adhesion with conventional bookbinding adhesives, etc. Such substrates include sheets or webs of woven and nonwoven fabrics of natural and synthetic fibers such as cotton; fibrous products such as paper and wood; single and multi-ply, continuous film products; and composites thereof. The fabrics and fibrous papers may be impregnated or sub-coated with a resinous or polymeric material to bond component fibers to seal pores therein, or to otherwise improve bulk and surface properties thereof.

Due to its relatively low cost, paper is preferred as the substrate for the manufacture mass-produced, quality book covers of both hard-and soft-cover types. Impregnated or sub-coated paper having a thickness from about 0.006 inch to about 0.012 inch (0.15–0.30 mm) is typically used in the manufacture of hard-cover books. Similar paper is used in the manufacture of soft-cover books except that the paper typically have a thickness from about 0.005 inch to about 0.030 inch (0.13–0.76 mm). In each instance, the paper should possess the required surfaces properties to be used with conventional bookbinding adhesives and processes.

A paper sheet comprising 20 to 95 parts of short fibers and 80 to 5 parts of long fibers, preferably 70 to 95 parts of short fibers and 30 to 5 parts of long fibers, is especially suited for book covers. Generally softwood fibers are longer than hardwood fibers. Hardwood fibers have a fiber length of from 1.4 mm to 1.9 mm with a concomitant diameter of from 14 to 40 microns. Softwood fibers have a fiber length of from 3.0 mm to 4.9 mm with a concomitant diameter of from 35 to 45 microns. The ratio of hardwood to softwood fibers is selected to provide a substrate exhibiting high adsorbancy for a saturating material and high uniformity.

The paper sheet is typically saturated with a saturant having a Tg of 5° C. to −50° C. The saturant comprises 5% to 50% on a dry weight basis of the resulting sheet. The saturant is selected to provide the substrate with the proper strength and flexibility. In addition, other factors that may be considered in the choice of the saturant include: price of the saturant, residual odor, heat and light stability, ability to bond to the cover material, chemical stability, holdout, and process considerations. Process considerations are those factors that influence runnability and include such factors as wettability (how fast the saturant penetrates into the sheet), foaming, skimming over, dryability (how easily the polymer releases water), rewettability, tackiness (if the saturant is too tacky, the web will stick to rolls or drying cans and the finished roll of material will tend to block). Typical saturants include emulsions of acrylics, vinyl acrylic copolymers, acrylonitrile acrylic copolymers, ethylene vinyl acetates, and various rubber emulsions. Methylol acrylamide and other monomers that provide curing sites are often included in the polymer backbone of the saturant to cross-link the polymer during drying. Typical saturants include: Hycar® 26092, Hycar® 26083, Hycar® 26322, Hycar® 26345, Hycar® 26796, and Hycar® V-43. Paper sheets suitable for use as substrates are disclosed by Brockington, U.S. Pat. No. 5,171,627, incorporated herein by reference.

Laminate Manufacture

The laminate is manufactured using conventional coating equipment and processes. In general, the production processes for manufacture of the coated book covers consists of the sequence of four process steps.

The first step is the preparation of the coating composition. The coating composition typically consists of a solution and/or dispersion of the coating solids in a volatile solvent such as an organic liquid or water. This composition is designed to have specific rheological properties for successful coating on the particular coater design employed. Viscosity ranges are very specific to the coating method employed, i.e., depending on the method used, viscosity may range from about 25 to 10,000 centipoise. The concentration of coating solids, i.e., non-volatile content, is dependent both on the viscosity tolerance of the coater and the available drying capacity in the subsequent process step.

For conventional roll coating the typical Brookfield RVT viscosity of the coating composition, measured with a #4 spindle at 20 rpm, is 2,000 to 4,000 cp. If necessary, viscosity can be further adjusted by addition of small amounts of conventional thickeners without adversely affecting the properties of the laminate.

The second step is the application, i.e., coating the coating composition onto the surface of the substrate to form a continuous, wet-film layer of uniform thickness. The coating can be pre- or post-metered to the substrate. Pre-meter coater types are direct and indirect gravure methods, reverse roll, extrusion die, and roller train designs. Post-meter types employ an air knife, rod, or blade. The post-meter types typically are more widely used for printing grades of paper. Depending on the type of equipment available, and the rheology of the wet coating formulation, the coating can be applied in as a single layer or in a multiple layer configuration. In addition, the substrate to be coated can influence the choice of application method. A rough, non-uniform substrate typically will require a thick single layer or multiple layers. Application rate is related to the surface structure of the substrate. Preferably, the air knife technique is used to apply the wet coating formulation to the substrate surface. An air knife, which is referred to as a contour type coater, applies a continuous, uniform film thickness to a substrate, independent of surface irregularities. This continuous layer of coating provides superior print fidelity and color reproduction on non-uniform substrates.

Typically, substrate 12 is in the form of a long web which is stored as a roll prior to coating. During the coating operation, the web is unwound from the roll and passed through the coating station of the coater. Typically the coated web then passes directly into a drying or curing unit.

The third step is the drying and/or curing of the coating to form the adherent solid coated layer 14. Following the application of the wet coating, the coated substrate typically is carried through a tunnel dryer wherein the coated layer is dried under controlled conditions to develop the proper coating structure. Any of the numerous available dryer designs may be employed in the proper manner, to dry the coated substrates. The particular drying conditions used are dependent upon the coating solvent, the choice of equipment used and production requirements. Typically, the web of dry coated substrate, or laminate, is wound into a roll for temporary storage before conversion to a format required by a bookbinder. Alternatively, some of the conversion steps may be employed before the web is wound into a roll. After drying, layer 14 is typically 15 to 30 microns thick, preferably 20 to 25 microns thick.

The fourth step is the conversion of the laminate into the format required by the bookbinder. This includes operations such as calendering, embossing, printing, and trimming and cutting webs or individual sheets to specified size. Some of these operations, such as calendering and embossing, can be carried out in-line before the laminate is wound into a roll. Alternatively, some of these operations, such as printing, trimming, etc., may be carried out by the bookbinder to meet individual book cover specifications required.

The laminate can be printed by conventional offset inks applied on commercial offset presses. It can also be processed by foil stamping, hot and cold embossing, gloss calendering, and supercalendering. Combinations of these operations also may be carried out to complete the finished product. After drying, the ink layer is typically 3 to 4 microns thick.

Protective Top Coat

Following printing or decoration, layer of cover material 14 is typically covered with protective top coat 20, which protects both the layer and the printing. The protective top coat must be compatible with the cover material and with the printing or decoration applied to surface 16 and must by suitable for the intended end use for the laminate. The abrasion resistance required by the final product is typically an important factor in determining the protective top coat selected. Typically the abrasion resistance of most top coat materials applied to the coating material of this invention is better than the abrasion resistance of the same top coat material applied in the same manner to a conventional printing paper.

Commonly applied protective top coats include: (1) water-based, clear acrylic topcoats, typically applied by an auxiliary coating on the offset printing press and dried by heat; (2) clear, ultraviolet-curable resins that comprise a photoinitiator, typically applied either by an auxiliary unit of an offset printing press or by a separate piece of coating equipment and cured by exposure to ultraviolet light; (3) press varnish, a clear or amber coating applied with a printing unit of an offset press and dried by evaporation or absorption of the solvent system. Although the particular protective top coat selected will depend on factors well known to those skilled in the art, water-based, clear acrylic topcoats are preferred for many applications because of their abrasion resistance, low cost, ease of application, and low toxicity. Ultraviolet-curable resins are typically preferred for applications in which high gloss is desired. Press varnish is typically not a preferred protective topcoat. Protective top coat 20 is typically 5 to 7 microns thick.

Book Cover Manufacture

The laminate may be used in the manufacture of both hard-cover and soft-cover book covers using conventional bookbinding operations and materials. A book typically comprises pages, which are connected at their inner edges by an edge binding, and a cover. The cover typically comprises a top panel, a bottom panel, and a spine. The spine connects the top and bottom panels and covers the edge binding. When the book is closed, the top and bottom panels are in contact with, and cover, the pages. The panels are generally the same size as, or slightly larger, than the pages. In a hard-cover book, the spine covers, but typically is not attached to, the edge binding. In a soft-cover book, the edge binding is typically attached the spine. Hard-cover books also typically comprise a pair of end pages, which are thicker and stronger than the other pages.

The cover for a hard-cover book comprises of a pair of stiff panels. These stiff cover panels typically are formed of cardboard, but could be formed of any composition of stiffening material. An outer covering material is cut to size and adhesively secured to the pair of stiff panels in such a way as to form spine and hinge areas to correspond with the edge binding of the pages. An end page is adhesively secured to the inner side of each of the panels so that the spine covers the edge binding, the spine connects the top and bottom panels, and a pair of hinge portions is formed, one between each panel and the spine. The outer side of the cover, that is, the side of the cover that is not in contact with the spine and is not contact with the pages when the book is closed, comprises the layer of cover material. The layer of cover material may have been coated directly onto the panels so that the panels function as substrate 12. Alternatively, the cover material may be coated onto substrate 12 and the uncoated side of substrate 12 adhered to the panels.

In the typical manufacture of a soft-cover book, a thick gauge covering material is cut to size and folded in such a way as to form hinges between the spine portion and the top and bottom panels. Because there are no stiff panels, the inner spine portion of the cover is adhesively secured to the edge binding. The edge binding may consists of adhesive securing the pages directly to the spine. In soft-cover books, the book cover material typically is not adhered to another material. The book cover material forms the cover of the book.

INDUSTRIAL APPLICABILITY

The coating material can be applied to either light or heavy weight papers or boards to form a coated sheet material which can be decorated by various means and covered with a protective layer to form a laminate that can be used in covers for both hard-and soft-cover books. The laminate can also can be used for the pages for books requiring a high level of durability, such as cook books, shop manuals, and books for young children. In addition, the laminate may be used in other applications whose requirements are equivalent to those of high quality book covers. Such applications include construction, packaging, boxes, dust covers, maps, folders, as well as hinged cases, such as for eye glasses or watches, and packages designed for repeated use, such as accordion files and hinged storage containers. The laminate can also be applied to extensible substrates, decorated, then deformed by heat and pressure, and used in any if these applications.

The advantageous properties of this invention can be observed by reference to the following examples which illustrate, but do not limit, the invention.

EXAMPLES

| Glossary | |
|---|---|
| Ansilex ® 93 | Calcined clay, 100% solids, (Engelhard Industries) |
| Hycar ® 2679 | Acrylic latex, 49.0% solids, Tg = −3° C. (B. F. Goodrich, Cleveland, OH) |
| Hycar ® 26796 | Self-thickening acrylic used as a paper saturant, Tg (DSC) = 4° C. (B. F. Goodrich, Cleveland, OH) |
| Hydrocarb ® 90 | Calcium carbonate (Omya, Proctor, VT) |
| Ludox ® TM | Silica sol, 50% solids (Du Pont, Wilmington, DE) |
| Rhoplex ® E-358 | High-solids, self-crosslinking acrylic emulsion, $T_i$ = 0° C. (Rohm & Haas, Philadelphia, PA) |
| Rhoplex ® E-32 | High-solids, self-crosslinking acrylic emulsion, $T_i$ = −2° C. (Rohm & Haas, Philadelphia, PA) |
| Rhoplex ® B-959 | Self-crosslinking acrylic copolymer, $T_i$ = 2° C. (Rohm & Haas, Philadelphia, PA) |
| Ropaque ® Hp-91 | Styrenated-acrylic pigmentary polymeric particles (Rohm & Haas, Philadelphia, PA) |
| San-Sil ® CG-102 | Amorphous silica (PPG, Pittsburgh, PA) |
| Syloid ® W-300 | Amorphous silica, 45% solids, average particle size 3.0 microns (W. R. Grace) |

-continued

| Glossary | |
|---|---|
| Syloid ® W-500 | Amorphous silica, 45% solids, average particle size 5.4 microns (W. R. Grace) |
| Ti-Tint ® White R-70 | Titanium dioxide (Technical Industries) |
| Ultra White ® 90 | Hydrated clay, 100% solids (Engelhard Industries) |
| Witco BB748 | Defoamer (Witco) |
| Witco 3056A | Defoamer (Witco) |

Example 1–8

The following coating compositions were prepared by first dispersing the pigments in water using a high-speed, high-shear, impeller type dispersing apparatus to achieve a stable, agglomerate free dispersion. Ammonium hydroxide was used to adjust the pH of the dispersion to about 8.4 to 8.5.

Each coating composition was applied to the surface of the substrate by a conventional roll coater and metered to the desired coating rate by a conventional air knife type devise. The coating rate was determined by the minimum quantity of coating material required to develop a smooth, uniform layer over the irregular substrate surface and was adjusted to produce a dried coating thickness of about 20 to 25 microns.

The substrate, 9720-006 -/- (Rexam-DSI, 1 Canal Street, South Hadley, Mass. 01705), a paper web used in the manufacture of coated book covers, was a 6 point, freesheet paper web saturated with a Hycar® 26796. The coated paper web then was transported into a conventional tunnel type drying chamber where the coated paper surface is raised to a temperature between about 125° F. and about 175° F. to remove the volatile content of the coating and initiate coalescence and curing of the dispersed polymer particles. The dried laminate was cooled to a temperature below 125° F. and then wound into a roll.

The laminate was flex tested using a conventional MIT fold endurance tester. The conventional test procedure was modified by running with 0 tension placed on the sample during testing. In this test, the sample is folded and unfolded through an arc of about 180° for each cycle.

Gloss was measured by a Gardner 75° NOVAGLOSS Glossmeter, which measures the amount of specular reflectance of a beam of light from a surface when a beam of light is incident on the surface at an angle of 75° from the surface plane. Viscosity was measured using a Brookfield LVT Viscometer with Spindle #4 at 20 rpm, and at about 72° F. Abrasion was measured by a Taber Abrader. The K&N test, a conventional test in the printing industry, measures ink absorption. A standard ink is placed on the coating for a period of time, rubbed off, and the reflectance optical density determined.

| | 1 | 2 | 3 | 4 |
|---|---|---|---|---|
| Coating Composition[1] | | | | |
| Water | 259.8 | 259.8 | 259.8 | 259.8 |
| Tamol ® 850 | 3.8 | 3.8 | 3.8 | 3.8 |
| Witco 3056A | 1.9 | 1.9 | 1.9 | 1.9 |
| Ti-Tint ® White R-70 | 166.3 | 166.3 | 166.3 | 166.3 |
| Ultra White ® 90 | 181.9 | 181.9 | 181.9 | 91.0 |
| Ansilex ® 93 | 156.0 | 156.0 | 156.0 | 156.0 |
| Syloid ® W-500 | 47.5 | — | — | — |
| Syloid ® W-300 | — | 47.5 | — | — |

-continued

| | | | | |
|---|---|---|---|---|
| San-Sil ® CG-102 | — | — | 20.6 | — |
| Hydrocarb ® 90 | — | — | — | 91.0 |
| Ammonia | 0.96 | 0.96 | 0.96 | 0.96 |
| Ropaque ® HP-91 | 93.5 | 93.5 | 93.5 | 93.5 |
| Hycar ® 2679 | 387.2 | 387.2 | 387.2 | 387.2 |
| Witco BB748 | 1.2 | 1.2 | 1.2 | 1.2 |
| Ammonia | 0.28 | 0.28 | 0.28 | 0.28 |
| Mix Properties | | | | |
| Filler/Binder Ratio | 2.6 | 2.6 | 2.6 | 2.6 |
| Brookfield RVT | | | | |
| Total mix (cp) | 1800 | 2275 | 2045 | 1365 |
| Mix dispersion (cp) | 900 | 875 | 675 | 500 |
| Coated Properties | | | | |
| Flex[2] | 4+ | 4+ | 4+ | 4+ |
| Gloss | 42 | 50.4 | 42.5 | 41.8 |
| K&N | 0.278 | 0.234 | 0.219 | 0.213 |
| Surface pH | 6.5 | 6.9 | 6.85 | 7.86 |
| Taber Abrasion[1] | 4+ | 4+ | 4+ | 4+ |

| | 5 | 6 | 7 | 8 |
|---|---|---|---|---|
| Coating Composition[1] | | | | |
| Water | 264.4 | 259.8 | 259.8 | 259.8 |
| Tamol ® 850 | 3.8 | 3.8 | 3.8 | 3.8 |
| Whitco 3056A | 1.9 | 1.9 | 1.9 | 1.9 |
| Ti-Tint ® White R-70 | 166.3 | 166.3 | 166.3 | 166.3 |
| Ultra White ® 90 | 181.9 | 181.9 | 181.9 | 91.0 |
| Ansilex ® 93 | 156.0 | 156.0 | 156.0 | 156.0 |
| Syloid ® W-500 | — | 45.7 | 45.7 | 45.7 |
| Ludox ® TM | 41.4 | — | — | — |
| Ammonia | 0.96 | 0.96 | 0.96 | 0.96 |
| Ropaque ® HP-91 | 93.5 | 93.5 | 93.5 | 93.5 |
| Hycar ® 2679 | 387.2 | — | — | — |
| Rhoplex ® E-358 | — | 316.2 | — | — |
| Rhoplex ® E-32 | — | — | 412.4 | — |
| Rhoplex ® B-959 | — | — | — | 345.0 |
| Witco BB748 | 1.2 | 1.2 | 1.2 | 1.2 |
| Ammonia | 0.28 | 0.28 | 0.28 | 0.28 |
| Mix Properties | | | | |
| Filler/Binder Ratio | — | 2.6 | 2.6 | 2.6 |
| Brookfield RVT | | | | |
| Total mix (cp) | 2185 | 300 | <200 | 820 |
| Mix dispersion (cp) | 570 | | | |
| Coated Properties | | | | |
| Flex[2] | | | | |
| Gloss | 54.4 | 48 | 42 | 41 |
| K&N | 0.179 | 0.295 | 0.27 | 0.293 |
| Surface pH | 6.80 | | | |
| Taber Abrasion[1] | 4+ | 4+ | 4+ | 5 |

[1]Amounts are in grams of ingredient as received.
[2]Scale is 1 to 5, with 5 being the best.

The layer formed in Example 1 had excellent compatibility when evaluated in offset printing press trials. It also had excellent ink lay as judged by visual observation of proofs made with an offset proof press.

Having described the invention, we now claim the following and their equivalents.

What is claimed is:

1. A laminate suitable for use as a book cover material, said laminate comprising:
   (A) a substrate; and
   (B) a layer of cover material adhered to said substrate, said cover material comprising:
      (1) an acrylic binder, said binder having a Tg of −10° to 10° C., and
      (2) a filler system, said filler system comprising
         (a) about 2.0% to about 7.0% of silica or a silicate;
         (b) about 28% to about 38% of calcined clay;
         (c) about 20% to about 27% of titanium dioxide; and
         (d) about 30% to about 45% of a white filler pigment;
   wherein the percentages are percents by weight based on the dry weight of the filler system, and wherein the ratio of filler system to binder is about 2.4 to 2.8.

2. The laminate of claim 1 wherein the Tg of the acrylic binder is about −5° C. to 5° C.

3. The laminate of claim 2 additionally comprising a protective top coat adhered to the layer of cover material.

4. The laminate of claim 1 wherein the substrate is paper.

5. The laminate of claim 3 additionally comprising a graphic image on said layer, wherein said graphic image is covered by said protective top coat.

6. A laminate suitable for use as a book cover material, said laminate comprising:
   (A) a substrate;
   (B) a layer of cover material adhered to said substrate, said cover material comprising:
      (1) an acrylic binder, said binder having a Tg of −10°to 10° C., and
      (2) a filler system, said filler system comprising
         (a) about 2.0% to about 7.0% of silica or a silicate;
         (b) about 28% to about 38% of calcined clay;
         (c) about 20% to about 27% of titanium dioxide; and
         (d) about 30% to about 45% of a white filler pigment;
   wherein the percentages are percents by weight based on the dry weight of the filler system, and wherein the ratio of filler system to binder is about 2.4 to 2.8, and
   wherein the filler system additionally comprises about 3% to about 7% by weight, based on the dry weight of the filler system, of a pigmentary polymeric particulate.

7. The laminate of claim 6 wherein the Tg of the acrylic binder is about −5° C. to 5° C.

8. The laminate of claim 6 wherein the substrate is paper.

9. The laminate of claim 7 wherein the filler system comprises about 3.0% to about 5.0% silica or silicate, about 30% to about 33% calcined clay, about 21% to about 25% titanium dioxide, about 33% to about 38% white filler pigment, and about 4% to 6% pigmentary polymeric particulate.

10. The laminate of claim 9 additionally comprising a protective top coat adhered to the layer of cover material.

11. The laminate of claim 10 additional comprising a graphic image on the layer of cover material, wherein said graphic image is covered by said protective top coat.

* * * * *